US007070424B2

(12) United States Patent
Obikane et al.

(10) Patent No.: US 7,070,424 B2
(45) Date of Patent: Jul. 4, 2006

(54) CONNECTOR FOR CONNECTING PRINTED BOARDS

(75) Inventors: Hiroaki Obikane, Tokyo (JP); Koji Hayashi, Tokyo (JP); Mamoru Suzuki, Tokyo (JP); Nobukazu Kato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/985,448

(22) Filed: Nov. 10, 2004

(65) Prior Publication Data

US 2005/0101163 A1 May 12, 2005

(30) Foreign Application Priority Data

Nov. 11, 2003 (JP) ..... 2003-381853

(51) Int. Cl.
*H01R 12/00* (2006.01)

(52) U.S. Cl. ..... 439/74; 439/941

(58) Field of Classification Search ..... 439/74, 439/941, 405, 676
See application file for complete search history.

(56) References Cited

U.S. PATENT DOCUMENTS 5,224,867 A 7/1993 Ohtsuki et al.
5,860,814 A * 1/1999 Akama et al. ..... 439/74
5,911,602 A * 6/1999 Vaden ..... 439/676
6,203,353 B1 3/2001 Huang et al.
6,464,515 B1 * 10/2002 Wu ..... 439/108
6,565,383 B1 5/2003 Wu
6,589,074 B1 7/2003 Wu
6,767,252 B1 * 7/2004 McGrath et al. ..... 439/637
2003/0064626 A1 4/2003 Kemmick et al.

FOREIGN PATENT DOCUMENTS

| | | |
|---|---|---|
| JP | 200-511300 | 8/2001 |
| JP | 2003-505826 | 2/2003 |
| WO | WO98/35408 | 8/1998 |
| WO | WO 03/026078 | 3/2003 |

* cited by examiner

*Primary Examiner*—Tulsidas C. Patel
*Assistant Examiner*—Larisa Tsukerman
(74) *Attorney, Agent, or Firm*—Collard & Roe, P.C.

(57) ABSTRACT

In a connector, a contact group has a signal contact and a ground contact, and the signal contact is arranged adjacently to both sides of the ground contact. Each of the signal contact and the ground contact has a contact portion connected to a partner side contact and also has a terminal portion connected to a connecting object. The pitch intervals between the terminal portions of the respective contacts of the contact group are equally set. The contact portion of the signal contact approaches the contact portion of the ground contact. Thus, the pitch interval between the contact portions of the adjacent signal contacts is widened with respect to the pitch interval between the terminal portions.

11 Claims, 10 Drawing Sheets

CONNECTOR FOR CONNECTING PRINTED BOARDS

This application claims priority to prior Japanese patent application JP 2003-381853, the disclosure of which is incorporated herein by reference.

BACKGROUND OF THE INVENTION

The present invention relates to a connector requiring impedance matching for electric characteristics, e.g., an increase in speed of LVDS, TMDS, PCI express transmission, etc., and more particularly relates to a connector having a joining portion joined to a substrate by soldering, etc., and a fitting portion coming in contact with a partner side connector, FPC or PCB.

A connector is shown in Japanese Patent Application Publication (JP-A) No. 2001-511300 (corresp. to WO98/35408), hereinafter called Reference 1, as the connector for connecting substrates to each other. The connector shown in Reference 1 is a connector for connecting two substrates so as to be perpendicular to each other and has a large-sized structure.

A socket connector and a plug connector are arranged in each of the mutual substrates to connect the substrates to each other. The substrates are connected by fitting these connectors to each other.

However, it is required that the connector for connecting printed boards to each other satisfies characteristics at high frequency in a field in which an electric signal becomes a high frequency wave. Further, the request of high density mounting is more and more increased. Therefore, a reduction in the pitch of a contact is also required.

In the conventional high speed signal transmission connector, the pitch between terminals as the distance between signal contacts as a pair must be increased to a certain extent for the purpose of electric characteristics such as matching of impedance at a differential transmission time. Therefore, there is a defect in that the connector is large-sized.

Further, in the connector of this kind, there is also an example in which the distance between the signal contacts as a pair is increased by arranging a dummy terminal for positively flowing no electric current between the signal contacts as a pair, and impedance is matched. However, a useless terminal or contact is correspondingly inserted so that there is a defect in that the connector becomes expensive.

On the other hand, there is a case opposed to the reduction in pitch as impedance characteristics among the electric characteristics. There is a defect in that the pitch of the connector is increased and the size of the connector itself is increased when the electric characteristics are preferentially set.

Further, there is a defect in that no electric characteristics are matched when the pitch is reversely preferentially reduced.

SUMMARY OF THE INVENTION

Therefore, it is an object of the present invention to provide a connector able to match impedance without setting the connector to be large-sized.

It is another object of the present invention to provide a cheaply manufactured connector able to match impedance in the connector without changing the pitch of a soldering portion as a terminal portion of the contact.

According to the present invention, there is provided a connector which includes a contact group and an insulator for holding the contact group. In the present invention, the contact group has a signal contact and a ground contact, and the signal contact is arranged adjacently to both sides or one side of the ground contact. Each of the signal contact and the ground contact has a contact portion connected to a partner side contact and also has a terminal portion connected to a connecting object. The pitch intervals between the terminal portions of the respective contacts of the contact group are equally set. The contact portion of the signal contact approaches or is separated with respect to the contact portion of the ground contact.

Here, in the present invention, the connecting object is constructed by a substrate, FPC, silicon, etc., and the terminal portion of the contact is constructed by a portion coming in contact with this object. Further, the same pitch interval shows a mountable state in the same condition with respect to soldering and line connection to the object. For example, this state is set to a state of the same height direction and the same width direction of a grounding portion or the corresponding directions, a state in which the tips are arranged properly, etc.

In the present invention, there is provided a connector in which the pitch interval between the contact portions of the adjacent signal contacts is widened with respect to the pitch interval between the terminal portions by widening the width of the contact portion of the signal contact toward the ground contact side instead of the construction in which the contact portion of the signal contact approaches the contact portion of the ground contact.

Here, in the present invention, it is preferable that the connecting object is a wiring board, and the terminal portion is a soldering portion soldered to this wiring board.

According to the present invention, there is provided a connector which includes a contact group and an insulator for holding the contact group. In the present invention, the contact group contains two ground contacts and a pair of signal contacts arranged between the two ground contacts. The each contact has a contact portion connected to a partner side contact and also has a terminal portion connected to a connecting object. The contact group is arranged so as to equally set the pitch interval between the terminal portions of the respective contacts. The contact portion of each of the pair of signal contacts approaches the contact portion of the partner side so that the pitch interval between the contact portions of the pair of signal contacts is set to be narrower than the pitch interval between the terminal portions.

Here, in the present invention, it is preferable that the connecting object is a wiring board, and the terminal portion is a soldering portion soldered to this wiring board.

According to the present invention, there is provided a connector in which pitch interval between the contact portions of the pair of signal contacts is set to be narrower than the pitch interval between the terminal portions by widening the width of the contact portion of each signal contact toward the signal contact side instead of the construction in which the contact portion of each of the pair of signal contacts approaches.

Here, in the present invention, it is preferable that the connecting object is a wiring board, and the terminal portion is a soldering portion soldered to this wiring board.

According to the present invention, there is provided a connector which includes a contact group and an insulator for holding the contact group. In the present invention, the contact group has a signal contact and a ground contact. The each contact has a contact portion connected to a partner side contact and also has a terminal portion connected to a connecting object. The pitch interval between the terminal portions of the respective contacts and the pitch interval between the contact portions are set to be equal to each other. The contact portion of the signal contact is arranged so as to be shifted from the contact portion of the ground contact in the direction crossing the pitch direction.

Here, in the present invention, it is preferable that the connecting object is a wiring board, and the terminal portion is a soldering portion soldered to this wiring board.

Further, according to the present invention, there is provided a connector which has the following construction. Namely, the connector is a plug connector, and the contact portion of the contact group is arranged so as to have a contact outside in the direction crossing the fitting direction of the connector. The partner side connector is a receptacle connector, and the contact portion of the partner side contact group has a contact inside in the direction crossing the fitting direction of the connector. The contact portions come in contact with each other in the crossing direction.

Further, according to the present invention, there is provided a connector which has the following construction. Namely, the connector is a receptacle connector, and the contact portion of the contact group is arranged so as to have a contact inside in the direction crossing the fitting direction of the connector. The partner side connector is a plug connector, and the contact portion of the partner side contact group has a contact outside in the direction crossing the fitting direction of the connector. The contact portions come in contact with each other in the crossing direction.

DESCRIPTION OF THE PREFERRED EMBODIMENTS

Figure 1:
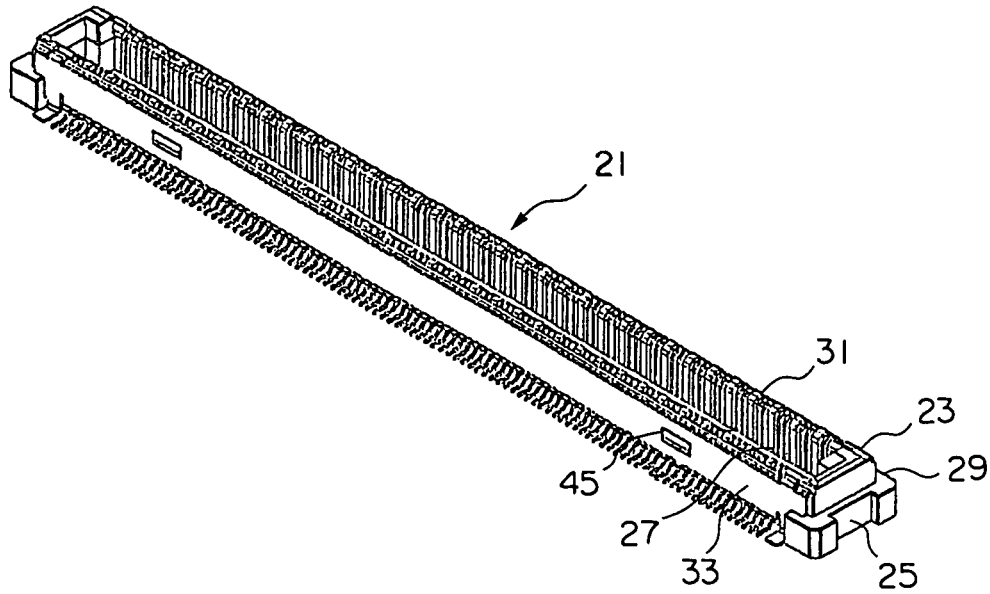
FIG. 1 is a perspective view showing a plug connector in accordance with a first embodiment of the present invention.
Figure 2:
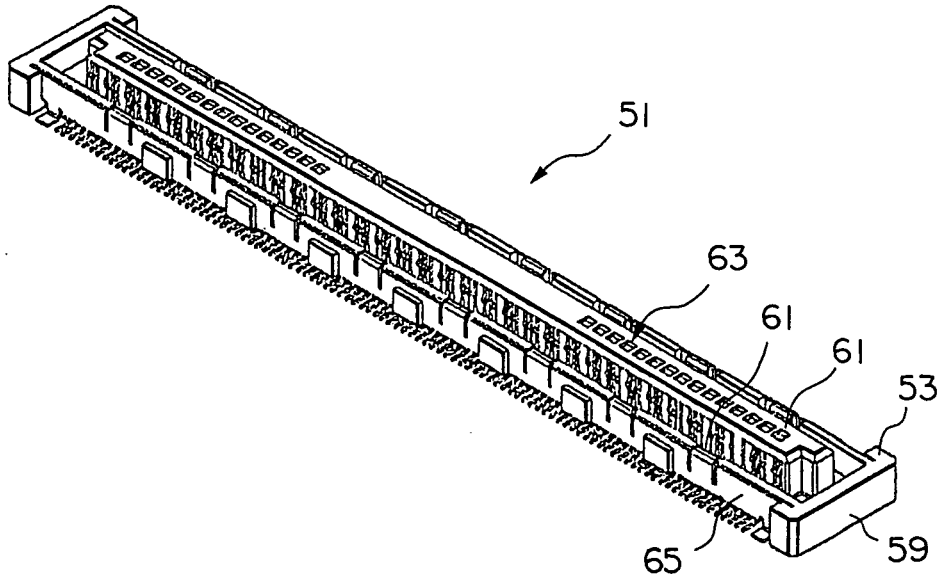
FIG. 2 is a perspective view showing a receptacle connector fitted to the plug connector of FIG. 1.
Figure 3:
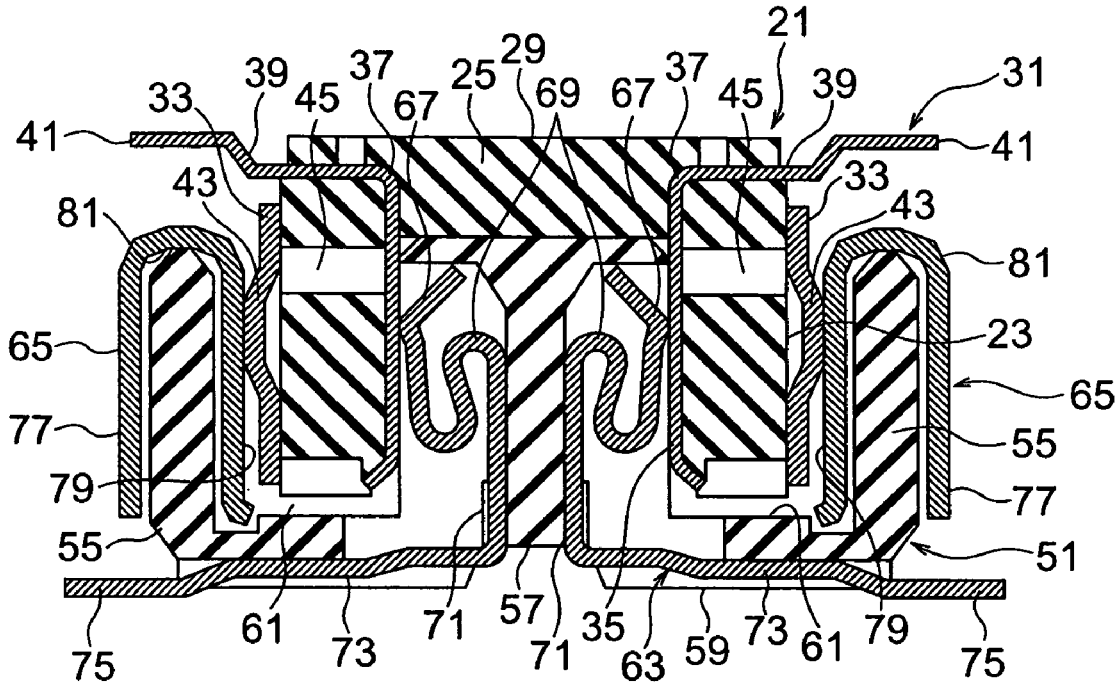
FIG. 3 is a cross-sectional view showing the fitting state of the plug connector of FIG. 1 and the receptacle connector of FIG. 2.

Now, preferred embodiments of the present invention will be explained with reference to the drawings.

Referring to FIGS. 1 to 8, a plug connector 21 has an insulator 29 of a long box type, a plug contact 31 and two shield plates 33 of the plug side.

The insulator 29 has a wall portion 23 for surrounding four sides of the insulator 29 in a long rectangular shape in a second direction perpendicular to a first direction as a fitting direction, a bottom plate 25 arranged on one end side in this fitting direction, and a rectangular fitting hole portion 27 long in the second direction at the center.

Each plug contact 31 is arranged in parallel with the second direction as the length direction of the connector on an opposite face which is long in the second direction and is opposed to a third direction perpendicular to the first and second directions inside the wall portion 23.

The two shield plates 33 of the plug side are respectively arranged so as to be opposed to the outside face of the long wall portion 23.

Each plug contact 31 has an elongated shape, and each tip portion of the plug contact 31 arranged on the opposite face is bent so as to be directed to the third direction as a mutual outside direction. The plug contact 31 has a contact portion 37, a support portion 39 and a terminal portion 41. The contact portion 37 is arranged from the tip portion of the plug contact 31 to the bottom plate 25 along the inside face 35 of the wall portion. The support portion 39 is perpendicularly bent in the third direction in this bottom plate 25 and is extended outside. The terminal portion 41 is projected from the outer face of the bottom plate 25 of the insulator 29, and is bent slantingly downward and is further bent upward and is extended so as to be approximately located on the same face along the exterior of the bottom plate face as the second direction.

The shield plate 33 has a projecting portion 34 and comes in contact with a shield plate of a receptacle connector described later. Reference numeral 45 designates a pulling hole in mold.

The receptacle connector 51 has an insulator 53 of a box type having a rectangular shape with a crossbar and long in a second direction (called the second direction similarly to the plug connector) perpendicular to a first direction (called the first direction similarly to the plug connector) as the fitting direction. The insulator 53 has a rectangular outer wall portion 55 long in the second direction, a central wall 57 and a bottom plate 59. The central wall 57 has a T-character shape in section and rises along the first direction at the center in a third direction (called the second direction similarly to the plug connector) perpendicular to each of the first and second directions. The bottom plate 59 is arranged on one end side in the first direction. Rectangular fitting hole portions 61 are arranged on both sides of the central wall 57. Receptacle contacts 63 are respectively arranged in parallel with the second direction on both the sides of the central wall 57 of the insulator 53. A shield plate 65 of the receptacle side having an inverse U-shape in section is arranged across the outside face via the upper face from the inside face of the long insulator 53.

Each receptacle contact 63 has an elongated shape and includes a contact portion 67, a spring portion 69, a vertical support portion 71, a horizontal support portion 73 and a terminal portion 75. The contact portion 67 has an elbowed shape and is opposed to both the sides of the central wall 57, and has a perpendicular shape by inside bending the tip portion of each contact 31 arranged in parallel with the second direction as the length direction. The spring portion 69 is formed in an S-character shape toward the central wall 57 from this contact portion 67. The vertical support portion 71 is lowered and extended in the first direction along the central wall 57 from the base portion of the spring portion 69. The horizontal support portion 73 is bent toward the outside from the lower end of the vertical support portion 71 and is extended to a groove arranged in the bottom plate 59 along the third direction. The terminal portion 75 is bent and exposed with respect to the bottom plate 59 from the horizontal support portion 73, and is extended in the third direction as the horizontal direction.

The shield plate 65 has a U-shape in section having an outside portion 77 arranged on the outside face of the outer wall portion 55 opposed to the third direction, an inside portion 79 arranged on the inside face, and a connecting portion 81 covering the upper face and connecting the outside portion 77 and the inside portion 79. In fitting, the inside portion 79 of the shield plate 65 of this receptacle connector 51 comes in contact with the projecting portion 43 of the shield plate 33 of the plug connector 21.

Figure 4:
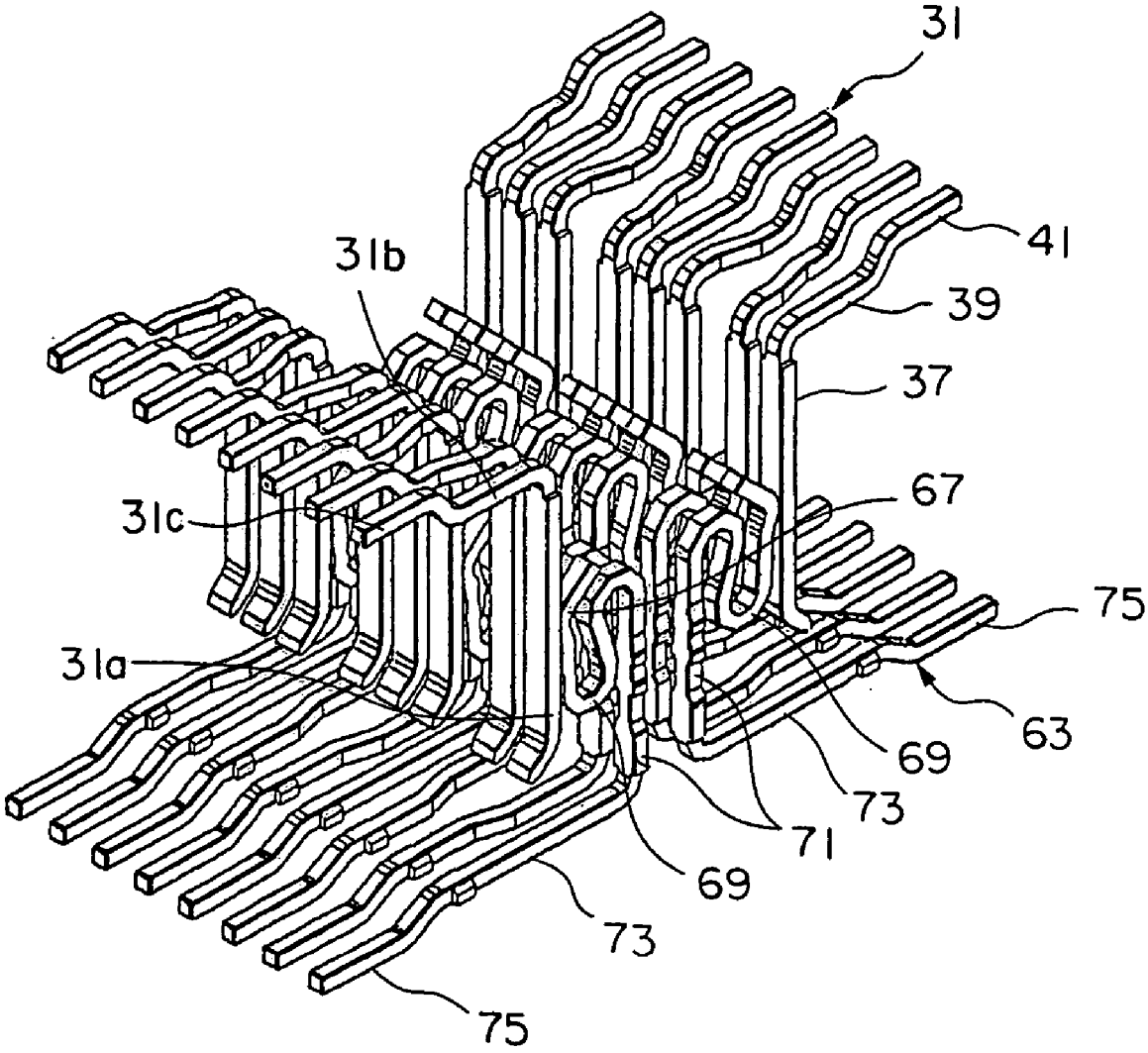
FIG. 4 is a perspective view showing only a contact of the connector fitting state of FIG. 3.

As shown in FIG. 4, when the plug connector 21 and the receptacle connector 51 are fitted, the contact portion 37 of each plug contact 31 and the contact portion 67 of the receptacle contact 63 of the receptacle connector 51 come in contact with each other in the direction perpendicular to the fitting direction, and attain an electrical connecting state.

Figure 5:
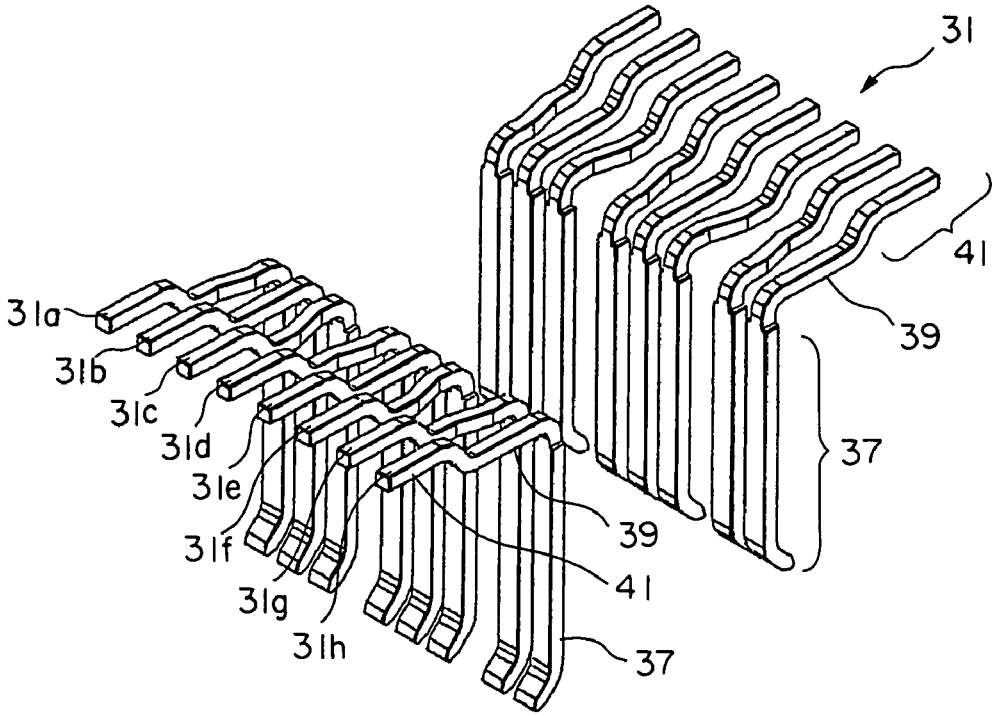
FIG. 5 is a perspective view showing a contact portion of the connector of FIG. 1.
Figure 6:
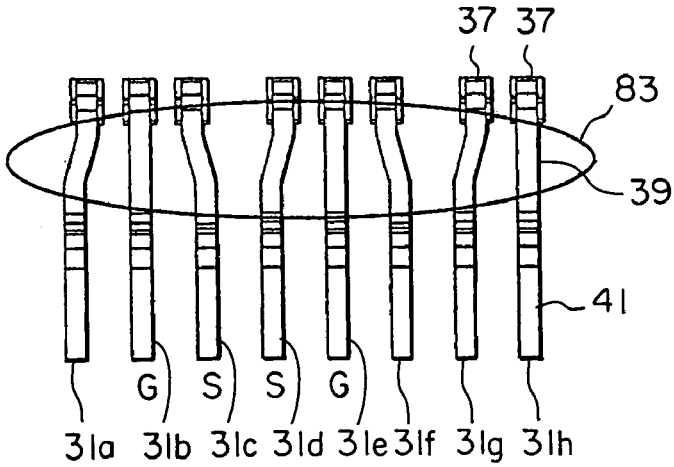
FIG. 6 is a partial plan view showing a pitch converting portion of the contact of FIG. 5.

Referring to FIGS. 5 and 6, plug contacts 31 are mutually symmetrically arranged in two columns in the width direction. For convenience of the explanation, reference numerals 31*a*, 31*b*, . . . , 31*h* are sequentially designated in the illustrated plug contacts 31. Each of the contacts 31*a*, 31*b*, . . . , 31*h* has the contact portion 37, the support portion 39 and the soldering terminal portion 41. In signal contacts 31*c*, 31*d* (S) adjacent to each other, one signal becomes S+ and the other becomes S− when differential transmission is set to an object.

Namely, the contact portions of the signal contacts 31*c*, 31*d* approach and are separated with respect to the contact portions 37 of ground contacts 31*b*, 31*e* by converting a pitch size in the pitch direction. At this time, the contact portions 37 of the signal contacts 31*c*, 31*d* approach and are separated with respect to the ground contacts 31*b*, 31*e* by changing the pitch size. In this case, the terminal portions 41 of the ground contact and the signal contact have the same arrangement and the pitch internal between the contact portions of the ground contacts 31*b*, 31*e* (31*f*, 31*g*) adjacent to each other is constructed so as to be widened or narrowed with respect to the distance between the terminal portions.

Concretely, in the plug contact 31 in the first embodiment of the present invention, the support portion 39 is slantingly bent on the right-hand side with respect to the third direction as the direction perpendicular to the pitch direction of the contact about contacts 31*a*, 31*d*, 31*g*, and is slantingly bent on the left-hand side with respect to the third direction about contacts 31*c*, 31*f*. Thus, the pitch between the contact portions 37 of the respective contacts 31 is changed and the pitch is increased in the direction separated from each other with respect to the contact portions 37 of signal contacts 31*a*, 31*c*, 31*d*, 31*g*. In contrast to this, a pitch converting portion 83 formed so as to narrow the pitch is arranged with respect to ground contacts 31*b*, 31*e*, 31*h* about the contact portions 37 of the signal contacts 31*a*, 31*c*, 31*d*, 31*g*.

Thus, impedance can be matched.

Figure 7:
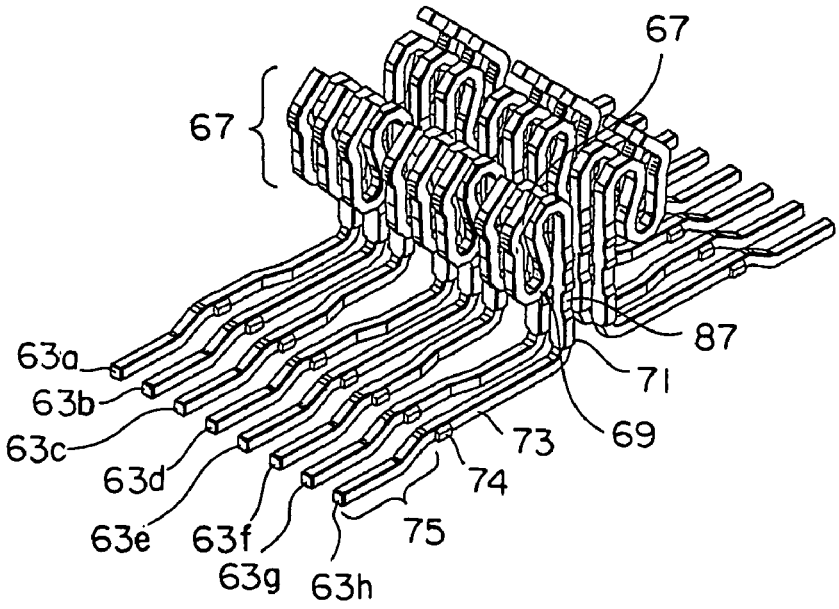
FIG. 7 is a perspective view showing a contact portion of the connector of FIG. 1.
Figure 8:
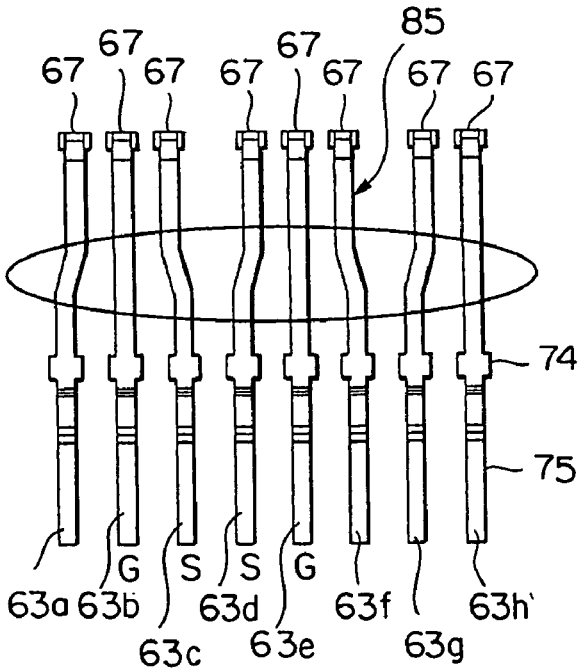
FIG. 8 is a partial plan view showing the pitch converting portion of the contact of FIG. 5.

Referring to FIGS. 7 and 8, receptacle contacts 63 are mutually symmetrically arranged in two columns in the width direction. For convenience of the explanation, reference numerals 63*a*, 63*b*, . . . , 63*h* are sequentially designated in the illustrated receptacle contact 63. Each contact has the contact portion 67, the spring portion 69, the vertical support portion 71, the horizontal support portion 73 with a projection 74, and the soldering terminal portion 75.

Namely, the contact portions 67 of signal contacts 63*c*, 63*d* approach and are separated with respect to the contact portions of ground contacts 63*b*, 63*e* by converting the pitch size in the pitch direction. At this time, the contact portion 67 approaches and is separated with respect to the ground contacts 63*b*, 63*e* by changing the pitch size. In this case, the terminal portions 75 of the ground contact and the signal contact have the same arrangement. The pitch interval between the contact portions 67 of the ground contacts adjacent to each other is constructed so as to be widened or narrowed with respect to the distance between the terminal portions 75.

Concretely, in the receptacle contact 63 in the first embodiment of the present invention, the support portion 73 is slantingly bent on the right-hand side with respect to the third direction as a direction perpendicular to the pitch direction about contacts 63*a*, 63*d*, 63*g*, and is slantingly bent on the left-hand side with respect to the third direction about contacts 63*c*, 63*f*. Thus, the pitch between the contact portions 67 of the respective contacts 63 is changed, and the pitch is increased in the direction separated from each other with respect to the contact portions 67 of the signal contacts 63*a*, 63*c*, 63*d*, 63*g*. In contrast to this, since ground contacts 63*b*, 63*e*, 63*h* are bidirectionally formed in the third direction, i.e., is straightly formed, the contact portions 67 of the signal contacts 63*a*, 63*c*, 63*d*, 63*g* have a pitch converting portion 85 formed so as to narrow the pitch with respect to the ground contacts 63*b*, 63*e*, 63*h*. Thus, impedance can be matched.

A plug connector and a receptacle connector in accordance with a second embodiment of the present invention will next be explained with reference to FIGS. 9 to 12. The connector in the second embodiment has a construction similar to that of the connector in the first embodiment except that the shapes of a plug contact and a receptacle contact in the second embodiment are different from those in the first embodiment. Accordingly, only each contact will be explained.

Figure 9:
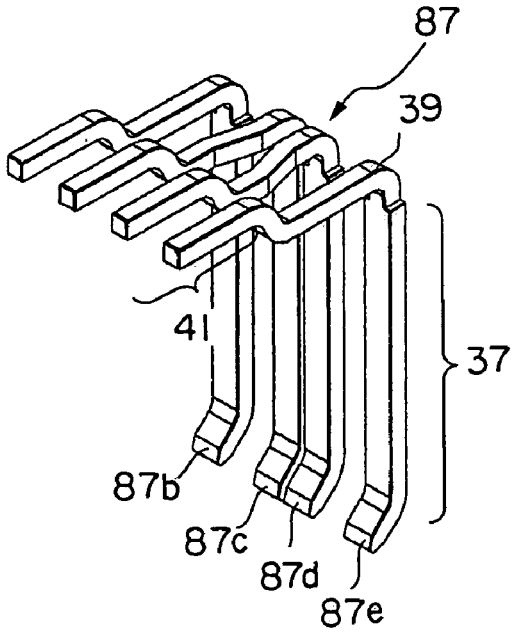
FIG. 9 is a partial perspective view showing the plug contact of a plug connector in accordance with a second embodiment of the present invention.
Figure 10:
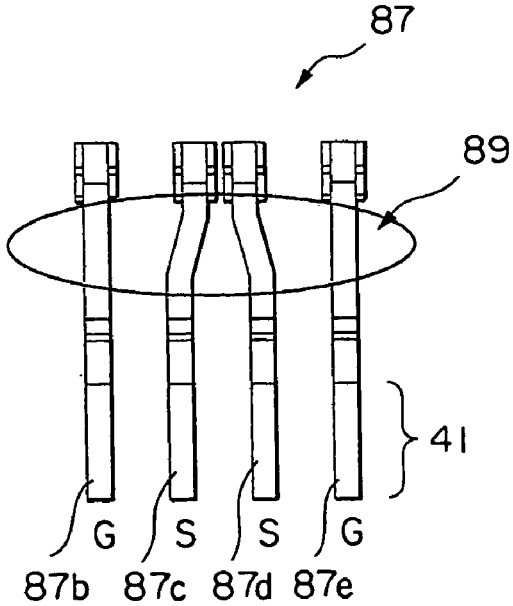
FIG. 10 is a partial plan view of the plug contact of FIG. 9.

Referring to FIGS. 9 and 10, plug contacts 87 are arranged in parallel with the second direction as the length direction of the connector perpendicular to the first direction as the fitting direction of the connector. For convenience of the explanation, reference numerals 87*b*, 87*c*, 87*e*, 87*d* are sequentially designated in the illustrated plug contact 87. Each contact has a contact portion 37, a support portion 39 and a soldering terminal portion 41.

Namely, the contact portions 37 of signal contacts 87*c*, 87*d* approach and are separated with respect to the contact portions 37 of ground contacts 87*b*, 87*e* by converting the pitch size in the pitch direction. At this time, the contact portion 37 approaches and is separated with respect to the ground contacts 87*b*, 87*e* by changing the pitch size. In this case, the terminal portions 41 as soldering portions have the same arrangement. The pitch interval between the contact portions of the ground contacts adjacent to each other is constructed so as to be widened or narrowed with respect to the distance between the terminal portions 41.

In the plug contact in accordance with the second embodiment of the present invention, the support portion 39 is slantingly bent on the right-hand side with respect to the third direction equal to the extending direction of the contact and perpendicular to the first and second directions about the contact 87*c*, and is slantingly bent on the left-hand side with respect to the third direction about the contact 87*d*. Thus, the pitch between the contact portions 37 of the respective contacts 87 is changed, and the pitch is reduced in the direction approaching each other with respect to the contact portions 37 of the signal contacts 87*c*, 87*d*. In contrast to this, a pitch converting portion 89 formed so as to widen the pitch is arranged with respect to the ground contacts 87*b*, 87*e* about the contact portions 37 of the signal contacts 87*c*, 87*d*. Thus, impedance can be controlled and matched.

Figure 11:
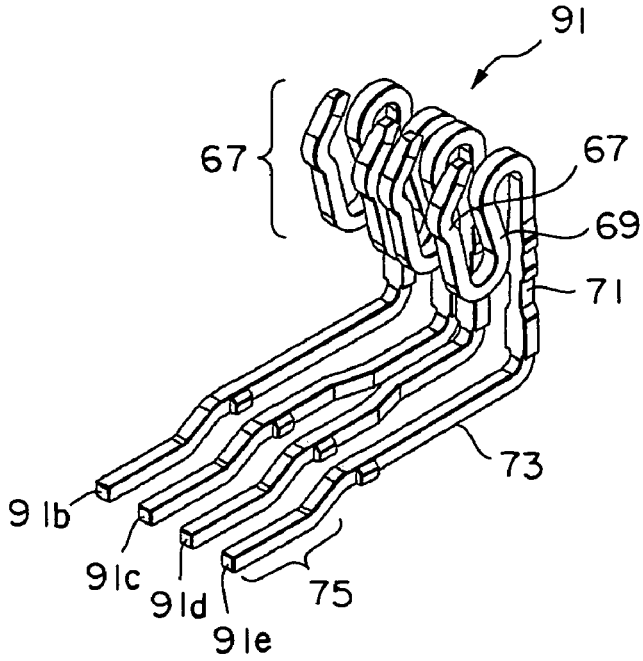
FIG. 11 is a partial perspective view showing the receptacle contact of a receptacle connector in accordance with the second embodiment of the present invention.
Figure 12:
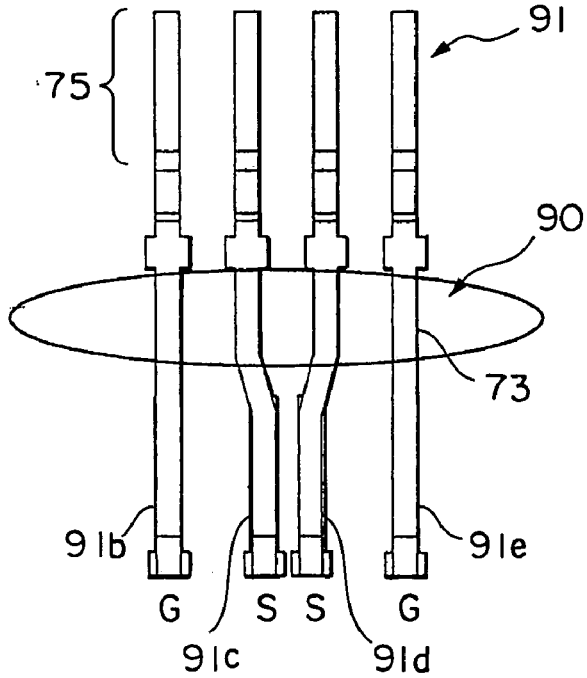
FIG. 12 is a partial plan view of the receptacle contact of FIG. 11.

Referring to FIGS. 11 and 12, receptacle contacts 91 are arranged in parallel with the second direction perpendicular to the first direction as the fitting direction of the connector and equal to the length direction of the connector. For convenience of the explanation, reference numerals 91*b*, 91*c*, 91*d*, 91*e* are sequentially designated in the illustrated receptacle contacts 91. Each contact has a contact portion 67, a spring portion 69, a vertical support portion 71, a horizontal support portion 73 and a soldering terminal portion 75.

In the receptacle contact 91, the contact portions 67 of signal contacts 91*c*, 91*d* approach and are separated with respect to the contact portions 67 of ground contacts 91*b*, 91*e* by converting the pitch size in the pitch direction. At this time, the contact portion 67 approaches and is separated with respect to the ground contacts 91*b*, 91*e* by changing the pitch size. In this case, the terminal portions have the same arrangement. The pitch interval between the contact portions 67 of the ground contacts 91*b*, 91*e* adjacent to each other is constructed so as to be widened or narrowed with respect to the distance between the terminal portions 75 as soldering portions.

Concretely, in the receptacle contact 91 in the second embodiment of the present invention, the support portion 73 is slantingly bent on the right-hand side with respect to the third direction perpendicular to the first and second directions and approximately equal to the extending direction of the connector about the contact 91*d*, and is slantingly bent on the left-hand side with respect to the third direction about the contact 91*c* so that a pitch converting portion 90 is formed. Thus, the pitch between the contact portions 41 of the respective contacts 91 is changed, and the pitch is reduced in the direction approaching each other with respect to the contact portions 37 of signal contacts 91 *c*, 91*d*. In contact to this, since the ground contacts 91*b*, 91*e* are straightly formed along the third direction, the contact portions 67 of the signal contacts 91*c*, 91*d* are formed so as to widen the pitch with respect to the ground contacts 91*b*, 91*e*. Thus, impedance can be controlled and matched.

A plug connector and a receptacle connector in a third embodiment of the present invention will next be explained with reference to FIGS. 13 to 16. The connector in the third embodiment has a construction similar to that of the connector in each of the first and second embodiments except that the shapes of a plug contact and a receptacle contact in the third embodiment are different from those in each of the first and second embodiments. Accordingly, similar to the second embodiment, only each contact will be explained.

Figure 13:
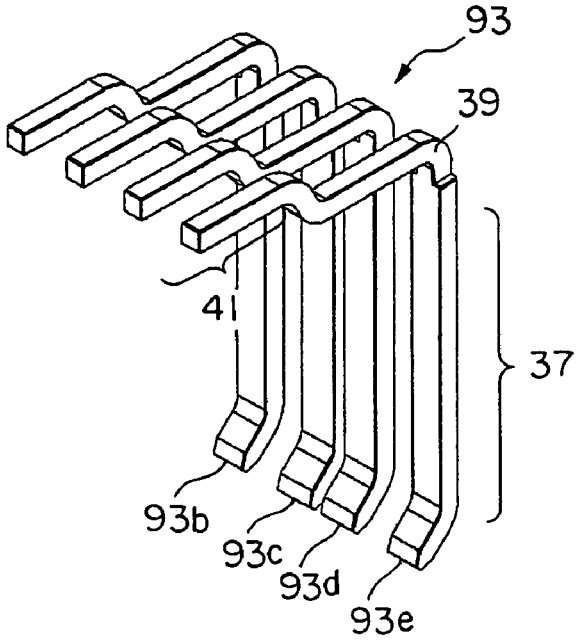
FIG. 13 is a partial perspective view showing the plug contact of a plug connector in accordance with a third embodiment of the present invention.
Figure 14:
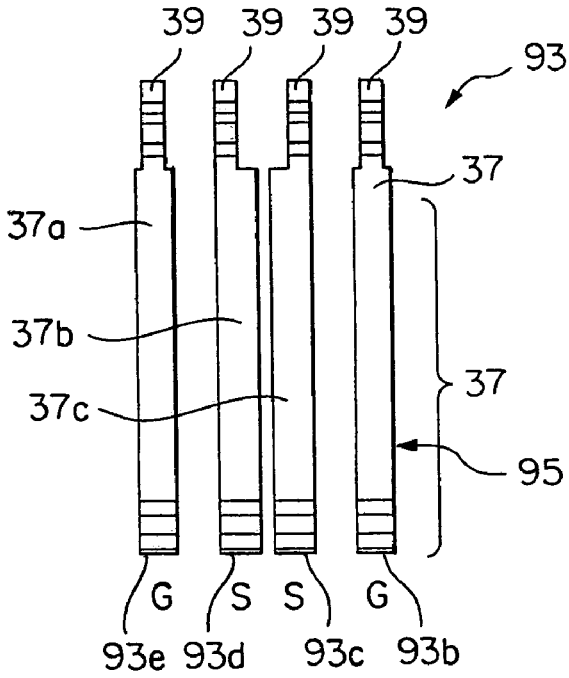
FIG. 14 is a partial plan view of the plug contact of FIG. 13.

Referring to FIGS. 13 and 14, plug contacts 93 are arranged in parallel with the second direction perpendicular to the first direction as the fitting direction of the connector and equal to the length direction of the connector. For convenience of the explanation, reference numerals 93*b*, 93*c*, 93*e*, 93*d* are sequentially designated in the illustrated plug contacts 93. Each contact has a contact portion 37, a support portion 39 and a soldering terminal portion 41.

Namely, the contact portions 37 of signal contacts 93*c*, 93*d* are separated and approach with respect to the contact portions 37 of ground contacts 93*b*, 93*e* by widening and narrowing the contact width in the pitch direction. Thus, the contact portion 37 is separated and approaches by widening and narrowing the width of the signal contacts 93*c*, 93*d* or the ground contacts 93*b*, 93*e*. The pitch between the contact portions adjacent to each other is constructed so as to be widened and narrowed with respect to the pitch interval between the terminal portions.

Concretely, in the plug contact 93 in the third embodiment of the present invention, the contact portion 37 is eccentrically formed so as to be widened on the right-hand side in the third direction perpendicular to the first and second directions with respect to the contact portion 37*b* of the contact 93*c*, and is eccentrically formed so as to be widened on the left-hand side in the third direction with respect to the contact portion 37*c* of the contact 93*d*. Thus, the pitch between the contact portions 37 of the respective contacts 93 is changed, and the pitch is reduced in the direction approaching each other with respect to the contact portions 37*c*, 37*d* of the signal contacts 93*c*, 93*d*. In contrast to this, a pitch converting portion 16 formed so as to widen the pitch is arranged with respect to the contact portions 37*a* of the ground contacts 93*b*, 93*e* about the contact portions 37*c*, 37*d* of the signal contacts 93*c*, 93*d*. Thus, impedance can be controlled and matched.

Figure 15:
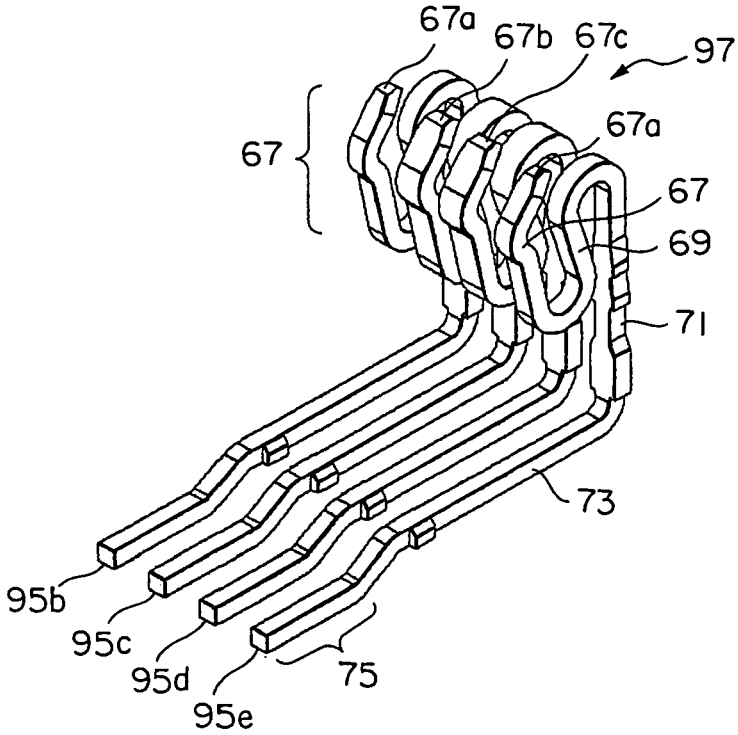
FIG. 15 is a partial perspective view showing the receptacle contact of a receptacle connector in accordance with the third embodiment of the present invention.
Figure 16:
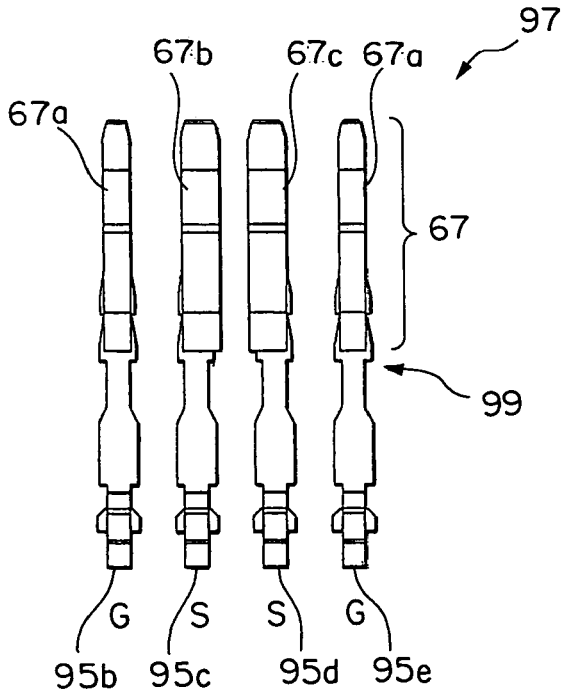
FIG. 16 is a partial plan view of the receptacle contact of FIG. 15.

Referring to FIGS. 15 and 16, receptacle contacts 97 are arranged in parallel with the length direction along the second direction perpendicular to the first direction as the fitting direction. For convenience of the explanation, reference numerals 97*b*, 97*c*, 97*d*, 97*e* are sequentially designated in the illustrated receptacle contacts 97. Each contact has a contact portion 67, a spring portion 69, a vertical support portion 71, a horizontal support portion 73 and a soldering terminal portion 75.

Namely, the contact portions 67*b*, 67*c* of signal contacts 97*c*, 97*d* are separated and approach with respect to the contact portions 67*a*, 67*d* of ground contacts 97*b*, 97*e* by widening and narrowing the contact width in the pitch direction. Thus, the contact portions 67*a*, 67*b*, 67*c*, 67*d* are separated and approach by widening and narrowing the width of the signal contacts 97*c*, 97*d* or the ground contacts 97*b*, 97*e*. The pitch interval between the contact portions 67*c*, 67*d* adjacent to each other is constructed so as to be widened and narrowed with respect to the pitch interval between the terminal portions 75 as soldering portions.

In the receptacle contact 97 in the third embodiment of the present invention, the contact portion 67 is widened in the right-hand side width in the third direction perpendicular to the first and second directions with respect to the contact portion 67*b* of the contact 97*c*, and is widened in the left-hand side width in the third direction with respect to the contact portion 67*c* of the contact 97*d*. Thus, the pitch between the contact portions 67 of the respective contacts 97 is changed, and the pitch is reduced in the direction approaching each other with respect to the contact portions 67c, 67d of the signal contacts 97c, 97d. In contrast to this, since the ground contacts 97b, 97e are formed with no eccentricity, a pitch converting portion 99 is formed in the contact portions 67 of the signal contacts 97c, 97d so as to widen the pitch with respect to the ground contacts 97b, 97e. Thus, impedance can be controlled and matched.

A plug connector and a receptacle connector in a fourth embodiment of the present invention will next be explained with reference to FIGS. 17 and 18. Since the connector in the fourth embodiment has a construction similar to that of the connector in each of the first to third embodiments except that the shape of a plug contact in the fourth embodiment is different from that in each of the first to third embodiments. Accordingly, similar to the second and third embodiments, only each plug contact will be explained.

Figure 17:
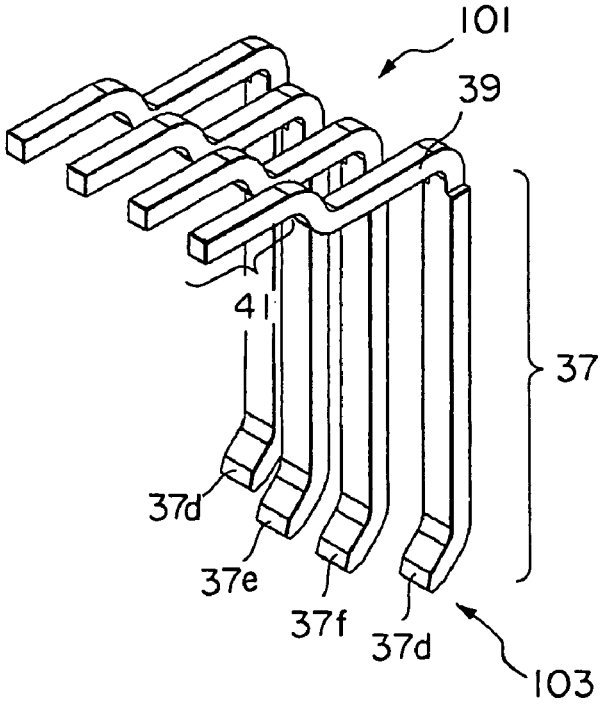
FIG. 17 is a partial perspective view showing the plug contact of a plug connector in accordance with a fourth embodiment of the present invention.
Figure 18:
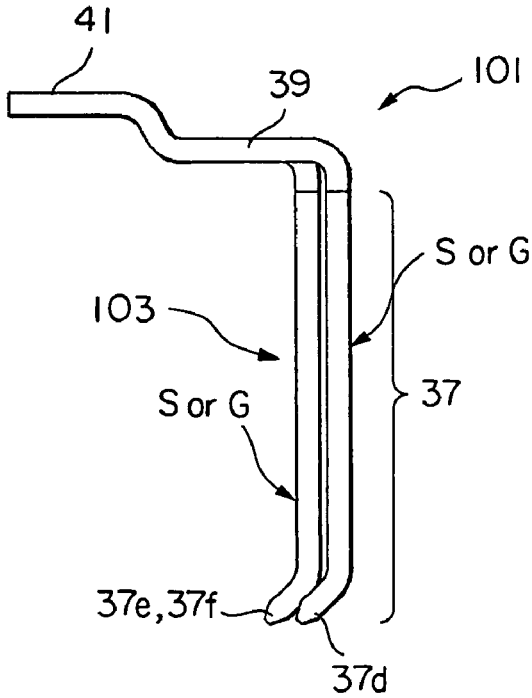
FIG. 18 is a partial side view of the plug contact of FIG. 17.

Referring to FIGS. 17 and 18, plug contacts 101 are arranged in parallel with the second direction as the length direction perpendicular to the first direction as the fitting direction. In the plug contact 101, reference numerals 37d, 37e, 37f, 37d are designated only in the contact portions 37. Each contact 101 has a contact portion 37, a support portion 39 and a soldering terminal portion 41.

The contact portion 37e, 37f or 37d of the signal contact 101 is shifted and arranged in the direction crossing the pitch direction with respect to the contact portion 37d, 37e or 37f of the ground contact 101 so that the contact portion 37e, 37f or 37d approaches and is separated from the contact portion 37d, 37e or 37f.

In the plug contact 101 in the fourth embodiment of the present invention, the contact portions 37e, 37f are formed so as to be located outside in the third direction perpendicular to the first and second directions with respect to the contact portion 37d of the contact 101. Thus, a pitch converting portion 103 is arranged and formed such that the pitches between the contact portions 37d and 37e and the contact portions 37d and 37f of the respective contacts 101 are changed, and the pitches are not changed in the direction approaching each other with respect to the contact portions of the signal contacts or the ground contacts, and are widened with respect to the contact portions 37d, 37e and the contact portions 37d, 37f of the signal contacts and the ground contacts. Thus, impedance can be controlled and matched.

Effects similar to those in the contact of the connector of the fourth embodiment of the present invention can be also obtained when the plate thickness of the contact in the direction crossing the pitch direction can be increased and decreased in the contact portion of the signal contact with respect to the contact portion of the ground contact as a modified example.

As explained above, in the connectors in the embodiments of the present invention, the description has been made in the case of the connector having the soldering terminal portion in the contact mounted to the printed wiring board. However, a structure for fixing the contact to a through hole may be also used. Further, a flexible wiring board or a flexible flat cable may be also used instead of the mounted printed wiring board. Further, an arranging structure in a wiring board of an electronic device, etc. may be also used.

Further, in the connectors in the embodiments of the present invention, the printed wiring board or FPC, etc. may be also used instead of the connector on the connecting partner side of one connector (the contact is constructed by a spring contact portion). When the partner is the board or the connector, the perpendicular boards can be constructed so as to be connected to each other. Further, the terminal portion of the contact is of a type for soldering the terminal portion to the board, but the cable may be also connected by a structure for press-attaching or press-contacting the terminal portion.

Further, in the connectors in the embodiments of the present invention, when the partner side connector is used in a part for setting an electric signal to a high frequency wave in the printed wiring board, impedance can be matched without increasing the size of the connector by converting the pitch of the contact portions of the connectors without changing the pitch of the terminal portion, e.g., the soldering portion.

Accordingly, in accordance with the present invention, it is possible to provide a connector able to control impedance within the connector by performing conversion for narrowing a signal contact or a pair of signal contacts used in high speed transmission by widening the distance of a fitting portion (contact portion and stub portion) of the connectors in the pitch direction and the opposite direction within each connector (on the plug side and the receptacle side).

Further, in accordance with the present invention, it is possible to provide a connector in which the pitch of the terminal, e.g., the soldering portion can be narrowed at the same pitch as the signal contact and the ground contact, and the connector itself is small in size and is cheaply manufactured without arranging the terminal flowing no electricity therethrough.

As explained above, the connector in the present invention can be applied to connection for the high frequency transmission of an electronic part, an electric part, etc. as well as a plug connector and a socket connector arranged for the connection between boards and transmitting a high frequency wave.

While this invention has thus far been described in conjunction with the preferred embodiments thereof, it will be readily possible for those skilled in the art to put this invention into practice in various other manners without departing from the scope of this invention.

What is claimed is:

1. A connector having a contact group and an insulator for holding said contact group, said contact group comprising at least one pair of signal contacts and at least one pair of ground contacts, each pair of said signal contacts being arranged adjacently between each pair of said ground contacts, each of said signal contacts and said ground contacts having a contact portion connected to a partner side contact and a terminal portion connected to a connecting object, the pitch intervals between the terminal portions of the signal contacts and the ground contacts of said contact group being equally set, the pitch intervals between the contact portions of said signal contacts and of said ground contacts being unequally set.

2. The connector according to claim 1, wherein the pitch interval between the contact portions of the adjacent signal contacts is widened with respect to the pitch interval between the terminal portions by widening the width of the contact portion of said signal contact toward said ground contact side instead of the construction in which the contact portion of said signal contact approaches the contact portion of said ground contact.

3. The connector according to claim 1, wherein the connector is used in a plug connector.

4. The connector according to claim 1, wherein the connector is used in a receptacle connector.

5. The connector having a contact group and an insulator for holding said contact group, said contact group comprising two ground contacts and a pair of signal contacts arranged between said two ground contacts, said each contact having a contact portion connected to a partner side contact and a terminal portion connected to a connecting object, said contact group being arranged so as to equally set the pitch interval between the terminal portions of the respective contacts, the contact portion of each of said pair of signal contacts approaching the contact portion of the partner side so that the pitch interval between the contact portions of said pair of signal contacts is set to be narrower than the pitch interval between the terminal portions.

6. The connector according to claim 5, wherein the pitch interval between the contact portions of the pair of signal contacts is set to be narrower than the pitch interval between the terminal portions by widening the width of the contact portion of each signal contact toward the signal contact side instead of the construction in which the contact portion of each of said pair of signal contacts approaches.

7. The connector according to claim 5, wherein the connector is used in a plug connector.

8. The connector according to claim 5, wherein the connector is used in a receptacle connector.

9. A connector having a contact group and an insulator for holding said contact group, said contact group comprising a pair of signal contacts and a pair of ground contacts, said pair of signal contacts being arranged adjacently between said pair of ground contacts, each contact having a contact portion connected to a partner side contact and a terminal portion connected to a connecting object, the pitch intervals between the terminal portions of said signal contacts and said ground contacts and the pitch interval between the contact portions being set to be equal to each other, the contact portions of said signal contacts being arranged so as to be shifted from the contact portions of the ground contacts in the direction crossing the pitch direction.

10. The connector according to claim 9, wherein the connector is used in a plug connector.

11. The connector according to claim 9, wherein the connector is used in a receptacle connector.

* * * * *